US009970182B2

(12) United States Patent
Pehlivan

(10) Patent No.: US 9,970,182 B2
(45) Date of Patent: May 15, 2018

(54) VACCIRC-VACUUM DRIVEN IN-WELL AIR STRIPPING AND RECIRCULATION

(71) Applicant: Mehmet Pehlivan, Mission Viejo, CA (US)

(72) Inventor: Mehmet Pehlivan, Mission Viejo, CA (US)

(73) Assignee: RAYS ENVIRONMENTAL REMEDIATION MANAGEMENT, Ladora Ranch, CA (US)

( * ) Notice: Subject to any disclaimer, the term of this patent is extended or adjusted under 35 U.S.C. 154(b) by 522 days.

(21) Appl. No.: 14/616,657

(22) Filed: Feb. 7, 2015

(65) Prior Publication Data

US 2016/0230527 A1 Aug. 11, 2016

(51) Int. Cl.
*E03B 3/12* (2006.01)
*E21B 43/00* (2006.01)
*E21B 43/12* (2006.01)

(52) U.S. Cl.
CPC ..... *E03B 3/12* (2013.01); *E21B 43/00* (2013.01); *E21B 43/12* (2013.01)

(58) Field of Classification Search
CPC ..... B09C 1/002; B09C 1/005; C02F 2103/06; E21B 43/12; E21B 43/18; E21B 43/385; E21B 43/40
See application file for complete search history.

(56) References Cited

U.S. PATENT DOCUMENTS 5,076,727 A * 12/1991 Johnson ..... B09C 1/062 405/128.35
5,246,309 A * 9/1993 Hobby ..... B01D 53/84 210/615
5,788,412 A * 8/1998 Jatkar ..... B09C 1/005 166/272.1
8,210,772 B2 * 7/2012 Gillecriosd ..... B01D 53/002 405/128.2
2004/0231513 A1 * 11/2004 Perkins ..... B01D 3/343 95/263

* cited by examiner

*Primary Examiner* — Joshua T Kennedy

(57) ABSTRACT

This invention has three parts: Part 1 Two-phase extraction of contaminated water and vapor from extraction wells using drop tubes with vertical slots or orifices; Part 2, Separation of extracted water and vapor/air at the wellhead or in a common manifold installed in ground, Part 3 injection of the extracted water using injection well with a drop tube similar to drop tube in the extraction well without the orifices or slots that extend above and below the water table. This invention strips volatile organic compounds from water, creates a recirculation cell in subsurface, increases biodegradation of organic compounds within the recirculation zone.

2 Claims, 2 Drawing Sheets

VACCIRC-VACUUM DRIVEN IN-WELL AIR STRIPPING AND RECIRCULATION

CROSS-REFERENCE TO RELATED APPLICATIONS

"Not Applicable"

STATEMENT REGARDING FEDERALLY SPONSORED RESEARCH OR DEVELOPMENT

"Not Applicable"

THE NAMES OF THE PARTIES TO A JOINT RESEARCH AGREEMENT

"Not Applicable"

INCORPORATION BY REFERENCE OF MATERIAL SUBMITTED ON A COMPACT DISK OR AS A TEXT FILEVIA THE OFFICE ELECTRONIC FILING SYSTEM (EFS-WEB)

"Not Applicable"

STATEMENT REGARDING PRIOR DISCLOSURES BY THE INVENTOR OR A JOINT INVENTOR

"Not Applicable"

BACKGROUND OF THE INVENTION

(1) Field of the Invention

This invention relates to soil and groundwater remediation for the sites that has contaminated with volatile organic compounds.

(2) Description of Related Art

U.S. Pat. No. 5,906,241, Pehlivan et al, May 25, 1999; "Method for Bubbling Extraction of Groundwater" This invention describes a system for lifting contaminated groundwater by placing a hole in the extraction pipe a short distance above the static groundwater table, thus causing a bubbling action to aid in the lift of the groundwater by an applied vacuum at the head of the pipe. It is also claimed that this bubbling gas aids in the stripping of contaminants from the groundwater. This invention forms bases for my Invention in terms of lifting the water using vacuum and stripping the volatile compounds from the groundwater. As a co-inventor of this invention, I used the thinking process of the Bubbling extraction to develop Vacuum Driven In-well stripping and Recirculation. However, the Bubbling Extraction is a process patent describing steps to lift the water to higher elevation above the applied vacuum. I went beyond the concept of Bubbling Extraction using vertical slots in addition to holes and returning the water back to same aquifer for further stripping and recirculation.

U.S. Pat. No. 5,246,309, Hobby, Michael M. Sep. 21, 1993; System and Method for Decontamination of Contaminated Ground. This invention uses a set of vapor extraction and air injection wells to remove contaminated vapor and run through a bio reactor to remove contaminant and the inject the air back into the subsurface under pressure using the injection wells. It is very different from my inventions because I do not inject air into vadose or saturated zone under pressure.

My invention strip volatile organic compounds from groundwater under vacuum during extraction from wells using drop tubes, separates vapor and water under vacuum (Sub-atmospheric pressure) in the separation column and return the water to injection well under gravity flow. As opposed to Hobby's invention, my invention does not use any compressed air, bioreactor, air injection into vadose or saturated zone.

United States Patent Application, US-20040231513-A1, Perkins, et al, Nov. 25, 2004; System for Inline Stripping of Soil Contaminants. This application describes methods and apparatus of inline air stripper using compressed air and venturi style inline air strippers (FIG. 2). These strippers are installed in series into the well. Compressed air is injected into the inline air stripper unit air amplifier section. Up to 150 psi injection pressure indicated for the compressed air. My invention does not use a separate inline stripper or air amplifier using compressed air. All extraction, stripping, and separation were done under vacuum (sub atmospheric pressure).

U.S. Pat. No. 8,210,772 B2, Gillecriosd, Marsaili. Jul. 3, 2012; Soil Vapor Extraction Remediation System with Vapor Stream Separation. This invention uses a set of vapor extraction well to remove vapor from vadose zone in subsurface and injection wells to inject oxygen, carbon dioxide or nitrogen into the vadose and/or saturated zone, inducing aerobic or anaerobic biodegradation in the subsurface. Injection is done under above atmospheric pressure using blower or compressor. My invention is very different than the GIllecriosd invention the fact that I do not use any pressure for injecting, all stripping and air water separation done under vacuum (sub-atmospheric pressure).

U.S. Pat. No. 5,076,727, Johnson et al, Dec. 31, 1991; In-Situ Decontamination of Spill and Landfills with Focused Microwave/Radio Frequency Heating and a Closed-Loop Vapor Flushing and Vacuum Recovery System. This invention involves extraction of vapor/air from the vadose zone in the subsurface, and treatment in the surface by either heating/burning and re-injecting the hot air into the subsurface in same zone of the extraction. This invention is not related or uses any of the extraction and injection methods described in my invention.

U.S. Pat. No. 5,788,412, Jatkar, Jayant. Aug. 4, 1998; Method for In Situ Contaminant Extraction from Soil, this invention uses hot oil circulation in the subsurface using piping system and to heat soil to facilitate extraction and volatilization of vapor by separate extraction wells. Invention only relates to conductive heating of the subsurface soil by hot oil recirculation. This invention is not anyway related to my invention however, it can be complimentary to heat the soil and groundwater to extract more organic compounds.

BRIEF SUMMARY OF THE INVENTION

The invention relates to groundwater treatment by creating a recirculation system using extraction and injection wells, a vapor extraction and vapor treatment system. Extraction of groundwater using a vacuum source and a drop tube is being used widely. This invention provides methods and apparatus to inject the extracted water back into the ground using gravity forces without a pump or push mechanism. With this apparatus, a re-circulation cell is created to recapture injected groundwater by the extraction well, which is equipped with a drop tube extraction mechanism.

DETAIL DESCRIPTION OF THE INVENTION

The Invention is comprised of the following components

Part 1—Groundwater extraction using a drop tube with vertical slots or holes extending from the bottom end of the tube below the water table to above the water table. The drop tube in the extraction well has vertical slots or holes in the bottom extending from below the water table to couple inches above the water table in the well that the tube is installed. When a vacuum is applied the distal end of the tube, both water and air enter the tube from the vertical slot or holes and both vapor and water are extracted together. During extraction up to 99% of the volatile organic compounds (VOC) are stripped off from the water and transferred into vapor phase.

Part 2—This part includes separation of extracted water and vapor in above ground, in-ground or in-well separation column (E), and transferring the water using conveyance piping (H) and injection drop tube (I) to injection well (IW) or injection zone in the same well separated by a packer and or seal from the extraction zone under vacuum tight condition.

Part 3—This part includes the injection of extracted groundwater, under vacuum using gravity drain in a drop tube (I) without slots which is installed in an injection well (IW) or in the injection zone of the recirculation well.

Air and water will be extracted from the extraction well (or zone) using two-phase extraction with drop tube (C) and vacuum. Volatile chemicals will be stripped off from the extracted water by the air during two-phase extraction in Part 1. The extracted water will be free of volatiles up to 99%. This cleaner water will be separated from the air/vapor in the separation column (E) in Part 2. The water that is cleaner and separated from the air/vapor will be injected into the injection well/zone (IW) under gravity flow in Part 3. This invention also increases dissolved oxygen in the extracted water during two-phase extraction in Part 1 while stripping volatile organic compounds. Water with increased dissolved oxygen and low levels of volatile organic compounds will increase biodegradation when injected into the injection wells and mixed with the groundwater around the injection well.

This invention may also be used to treat the contaminated water in above ground tanks and vessels.

This invention may be applied using two separate wells (one extraction and one injection well) installed in different boreholes (FIG. 1), a dual nested well pair installed in the same borehole with a dual completion separated by a bentonite seal with two screen intervals (not shown in figures).

Figure 1:
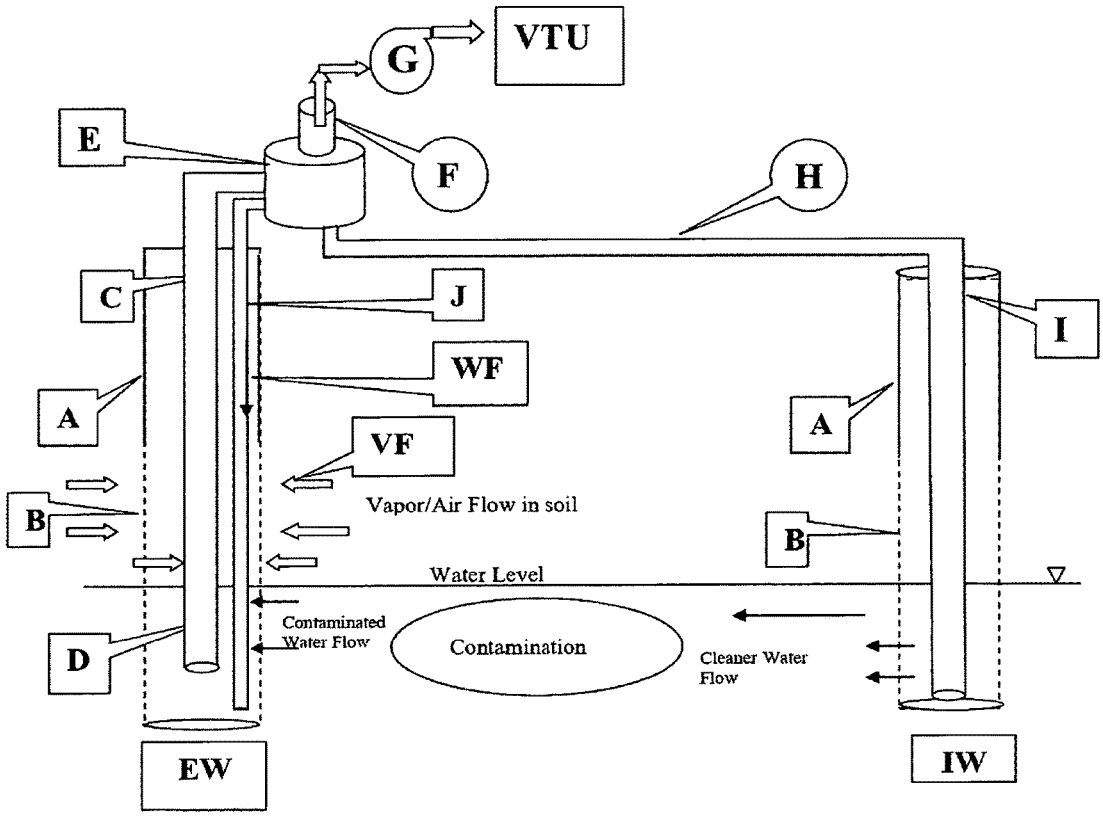
FIG. 1 shows the invention with one extraction well (EW) and one injection well (IW). Referring to the FIG. 1, A is the well casing, 4-inch diameter or larger, above the screen interval installed in a borehole drilled with a drilling rig. The well casing is secured with bentonite or cement grout. B is slotted casing below the solid well casing (A) extending from total depth of the well to above the groundwater level. Filter pack sand is used around the slotted casing interval (B) of the well casing for both injection and extraction wells (not shown in figures). C is the capillary extraction drop tube one-inch or smaller diameter extending from the total depth of the well to the top of the well casing. D is the vertical slots or holes in the bottom of the drop tube (C) extending from the distal end of the drop tube to above the static groundwater level. E is the air and water separation column (or chamber). F is solid piping connecting the separation column (E) to the extraction blower for vapor flow. G is blower moving vapor from separation column to vapor treatment unit (VTU) and discharge system (Not Shown). (H) is solid piping connecting the separation column (E) to the injection well drop tube for water flow. I am the injection well drop tube without slots or holes in the Injection well (IW). J is the excess water drop tube without slots or holes in the extraction well (EW).

FIG. 1 shows the invention with one extraction well (EW) and one injection well (IW). When vacuum is applied at G, the vacuum will be equally distributed to the separation column (E) and injection drop tube (I) and extraction well drop tubes (C). Water in the extraction well drop tube and injection well will rise as a response to the vacuum. Air will enter to the drop tube in the extraction well from vertical slots (D) and lift the water to the separation column (E). Pehlivan et al (U.S. Pat. No. 5,906,241) described that water may rise up to 5 times of the applied vacuum in the drop tube with holes. Since there are no holes or slots in the injection drop tube (I) in the injection well, there will be no flow to the separation column from the injection well. Water in the separation column will drain into the injection well (IW) under gravity flow. During extraction and air entrainment in the drop tube in the extraction well, most of the volatile compounds will be stripped off from water and transferred into the vapor phase and treated in the vapor treatment unit (VTU). Water with less volatile compounds will be recirculated from the injection well (IW) to the extraction well (EW) in the subsurface through the soil and groundwater zone.

Figure 2:
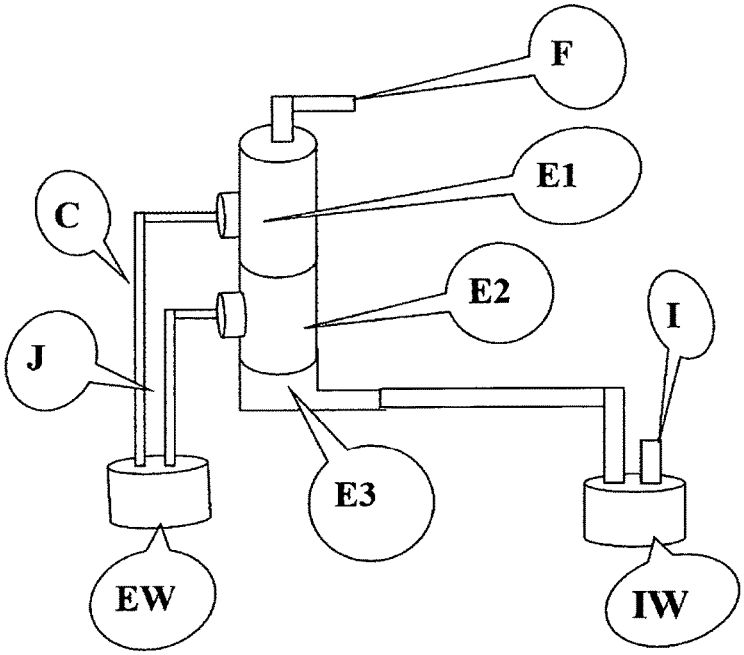
FIG. 2 shows the wellhead air/water separation system for dual well operation of (two separate wells) vacuum driven in-well stripping and recirculation system. EW is extraction well head that is equipped with a cap to secure two drop tubes to the 4-inch extraction well casing. C is extraction drop tube as shown in the FIG. 1. E1, E2 and E3 are parts of separation column E. E1 and E2, are made of 4-inch diameter PVC tees installed on top of each other to create air/water separation column (E). E3 is a reducing coupling or elbow connecting 4-inch diameter separation column to 1-inch diameter injection drop tube (I). E1 and E2 can be modified and replaced with a smaller diameter PVC tees or custom manufactured container or a tank. Extraction drop tube (C) is connected to the upper tee (E1) as shown. Excess water recirculation drop tribe (J) is connected to the lower tee (E2) as shown. An elbow (E3) was placed bottom of the lower tee (E2) and connected to the piping extending to injection well drop tube (I). Top of the upper tee (E1) is connected to the vapor extraction line (F). Injection drop tube (I) is secured on injection well head (IW) and extends to the bottom of the Injection well (IW) as shown in FIG. 1.

FIG. 2 shows the wellhead air/water separation system for dual well operation of (two separate wells) vacuum driven in-well stripping and recirculation system.

When Vacuum is applied to the vapor extraction line (F), the vacuum transferred to the extraction drop tube (C), excess water recirculation drop tube (J) and Injection drop tube (I). Bottom end of both Injection drop tube (I) and excess water recirculation drop tube (J) are submerged under water and have no holes or vertical slots above the water table. Extraction drop tube (C) has holes above the water level. When vacuum is exerted to drop tubes, water and vapor will flow from extraction drop tube (C) into the upper tee (E1) and water will be separated from vapor. Vapor will flow to the vapor extraction line (F) and treated by the vapor treatment system and discharged to the atmosphere. Water will flow down into the lower tee (E2) and elbow (E3) under gravitational forces. Water will continue to flow to the injection well drop tube (I) and flow to the bottom of the drop tube and into the injection well screen. Water will create mound in the injection well as recirculation continues and will flow into the soil through the screen zone and the filter sand under gravitational forces. This water will be captured by the drawdown cone created by the extraction well (EW), eventually creating a closed loop recirculation cell in the subsurface as shown in FIG. 1. When rate of extraction exceeds the rate of injection due to lower capacity of the injection well (IW) or lower permeability of the soil around the injection well, water will rise in the injection well and injection drop tube (I). As a response to the rising water in the injection well (IW), water in the injection drop tube (I) will also rise and eventually may reach to the Elbow (E3 in FIG. 2) and to the lower tee (E2). When the water rises to E2 location, the water will flow into the excess water recirculation drop tube (J) and flow back into the extraction well. This will reduce the rate of injection at the injection well (IW) by recirculating the excess water in the extraction well. This will allow injection to continue at a rate sustainable by the injection well. If necessary, another injection well may be installed to receive some or all of the excess water. Any additional injection well may be connected to the conveyance piping (H) at the same elevation of the conveyance piping and injection well head to facilitate flow into the injection drop tube (I).

What is claimed is:

1. A vacuum driven in-well stripping and recirculation system comprising:

a vacuum tight subsurface separation column;

an extraction drop tube connected to a proximal end to an entry point of said separation column and configured to extend into and extraction well, said extraction drop tube comprising perforations at a distal end thereof;

a vacuum blower attached to said separation column which applies a vacuum to extract water through said extraction drop tube into said separation column;

wherein said separation column is configured to separate water and vapor;

a vapor treatment unit extending from the separation column into which the vapor is diverted;

an injection drop tube connected to said separation column at an exit point, said injection drop tube having a bottom opening, but no perforation in walls thereof, wherein the separated water from said separation column is configured to be diverted into said injection drop tube via gravity and into in an injection well through said bottom opening of said injection drop tube; and an excess water return line extending from said separation column into said extraction wherein it a rate of extraction from the extraction well exceeds a rate of injection into the injection well causing a rise of water within in the injection drop tube and into the separation column, the excess water return line is configured to direct the excess water back into the extraction well.

2. The vacuum driven in-well stripping and recirculation system of claim 1 wherein said extracted water is transferred to said injection drop tube by applying vacuum to both said extraction and said injection drop tubes, creating a recirculation zone in a subsurface between extraction and injection wells.

* * * * *